US006071058A

United States Patent [19]

Tetz et al.

[11] Patent Number: 6,071,058

[45] Date of Patent: Jun. 6, 2000

[54] REFUSE LOADER WITH VEHICLE MOUNTED GUIDE RAILS

[75] Inventors: Warren Tetz; Lam Chi Luong, both of Edmonton, Canada; Norman Laverne Heaman, 11 Meadow Crescent, Edmonton, Canada, T6C 1G1

[73] Assignee: Norman Laverne Heaman, Edmonton, Canada

[21] Appl. No.: 09/107,906

[22] Filed: May 22, 1998

Related U.S. Application Data

[63] Continuation-in-part of application No. 08/769,074, Dec. 18, 1996, abandoned.

[51] Int. Cl.[7] ..... B65F 3/08

[52] U.S. Cl. ..... 414/409

[58] Field of Search ..... 414/409, 486, 414/487

[56] References Cited

U.S. PATENT DOCUMENTS

| | | | |
|---|---|---|---|
| 3,966,067 | 6/1976 | Reese | 414/409 |
| 4,941,796 | 7/1990 | De Filippi | 414/409 |
| 5,007,786 | 4/1991 | Bingman | 414/409 |
| 5,035,563 | 7/1991 | Mezey | 414/409 |
| 5,092,731 | 3/1992 | Jones et al. | 414/409 X |
| 5,344,273 | 9/1994 | Radlein | 414/409 |
| 5,702,225 | 12/1997 | Ghibaudo | 414/409 X |

*Primary Examiner*—Steven A. Bratlie
*Attorney, Agent, or Firm*—Davis and Bujold

[57] ABSTRACT

A refuse loader with vehicle mounted guide rails which includes a pair of guide rails at least one of which has a longitudinally extending gear profile. A trolley is provided having a motor and at least one driven gear driven by the motor. The driven gear engages the longitudinally extending gear profile. Guide rollers keep the trolley engaged with the guide rails. Outwardly extending lift arms fixedly attached to the trolley are provided for detachably securing a refuse container to the trolley. When the motor is activated, the driven gear rotates and the trolley moves relative to the guide rails as the driven gear moves along the longitudinally extending gear profile.

6 Claims, 5 Drawing Sheets

REFUSE LOADER WITH VEHICLE MOUNTED GUIDE RAILS

This application is a continuation-in-part application in connection with the U.S. patent application Ser. No. 08/769,074 filed on Dec. 18, 1996, now abandoned.

FIELD OF THE INVENTION

The present invention relates to a refuse loader for a garbage truck and, in particular, a refuse loader that has vehicle mounted guide rails.

BACKGROUND OF THE INVENTION

Crane Carrier Company of Tulsa, Okla. holds two patents relating to refuse loaders for garbage trucks that utilize vehicle mounted guide rails. U.S. Pat. No. 4,538,951 which issued in September of 1995 discloses a refuse loader mounted to a front of a vehicle. U.S. Pat. No. 5,044,863 which issued in September of 1991 discloses a refuse loader mounted to a side of a vehicle. Each of the Crane Carrier Company refuse loaders have actuator arms that are moved by hydraulic cylinders. The actuator arms have rollers that engage the guide rails, so that the path of the actuator arms is determined by the configuration of the guide rails.

Unfortunately, when the actuator arms and hydraulic cylinders require servicing the entire garbage truck must temporarily be taken out of service.

SUMMARY OF THE INVENTION

What is required is an alternative configuration for a refuse loader that uses vehicle mounted guide rails that is easier to service.

According to the present invention there is provided a refuse loader with vehicle mounted guide rails, comprising: a pair of guide rails at least one of which has a longitudinally extending gear profile; a trolley having a motor and at least one driven gear driven by the motor, the driven gear engaging the longitudinally extending gear profile; means for keeping the trolley engaged with the guide rails; at least one arm being fixedly secured to the trolley for detachably securing a refuse container to the trolley; motor control means for activating the motor such that the driven gear rotates and conveys the trolley and said at least one said lifting arm along the guide rails as the driven gear moves along the longitudinally extending gear profile; and the guide rails having a sufficiently curved profile that enables said motor control means to be a sole mechanism for conveying the trolley and said at least one lifting arm to a sufficiently inverted dumping position by following along the guide rails, thereby dumping the refuse container in one continuous motion without any pivoting motion of said at least one lifting arm.

According to the present invention there is also provided a refuse loader with vehicle mounted guide rails, comprising: a pair of guide rails at least one of which has a longitudinally extending gear profile; a trolley having a motor, at least one driven gear driven by the motor, the driven gear engaging the longitudinally extending gear profile, and at least one guide roller for clamping the guide rails between the driven gear and the guide roller so as to keep the trolley engaged with the guide rails; at least one arm being fixedly secured to the trolley for detachably securing a refuse container to the trolley; motor control means for activating the motor such that the driven gear rotates and conveys the trolley and said at least one said lifting arm along the guide rails as the driven gear moves along the longitudinally extending gear profile; and the guide rails having a sufficiently curved profile that enables said motor control means to be a sole mechanism for conveying the trolley and said at least one lifting arm to a sufficiently inverted dumping position by following along the guide rails, thereby dumping the refuse container in one continuous motion without any pivoting motion of said at least one lifting arm.

BRIEF DESCRIPTION OF THE DRAWINGS

The invention will now be described, by way of example, with reference to accompanying drawings, wherein.

DETAILED DESCRIPTION OF THE PREFERRED EMBODIMENT(S)

Figure 1:
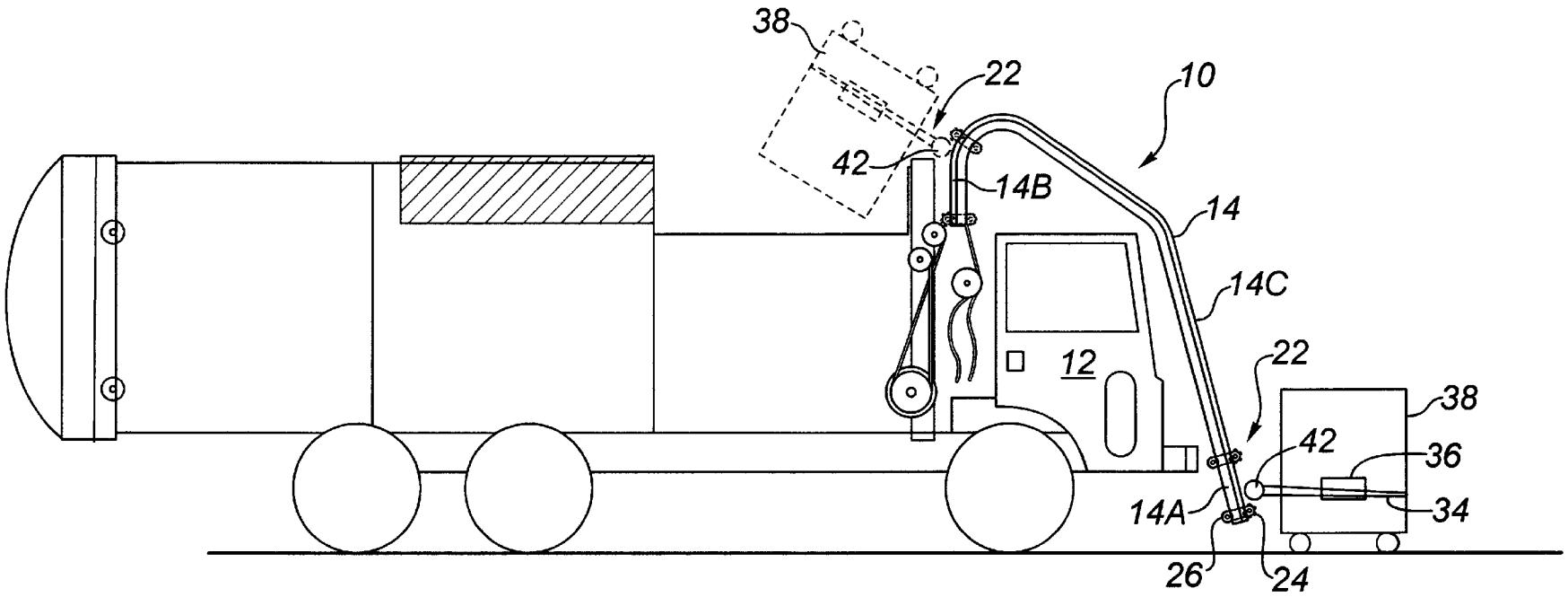
FIG. 1 is a side elevation view of a garbage truck having a refuse loader with vehicle mounted guide rails constructed in accordance with the teachings of the present invention.

The preferred embodiment, a refuse loader with vehicle mounted guide rails generally identified by reference numeral 10, will now be described with reference to FIGS. 1 through 5.

Figure 3:
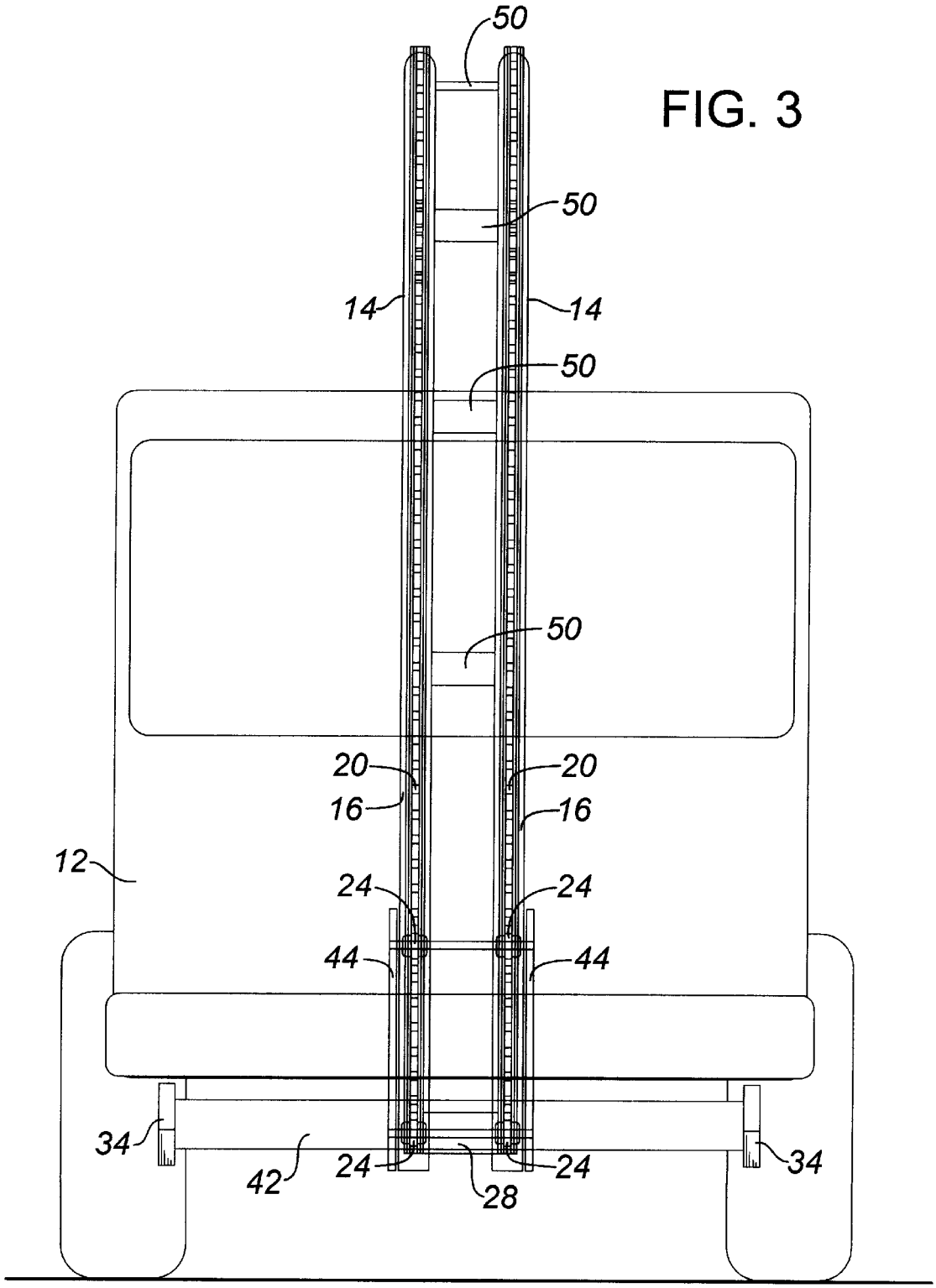
FIG. 3 is a front elevation view of the garbage truck illustrated in FIG. 1.

Referring to FIGS. 1 and 3, refuse loader 10 is mounted on a garbage truck 12. The refuse loader 10 consists of a pair of guide rails 14 and trolley 22 with lifting arms to support a refuse container 38. Guide rails 14 are detachably mounted on the garbage truck 12.

Figure 2:
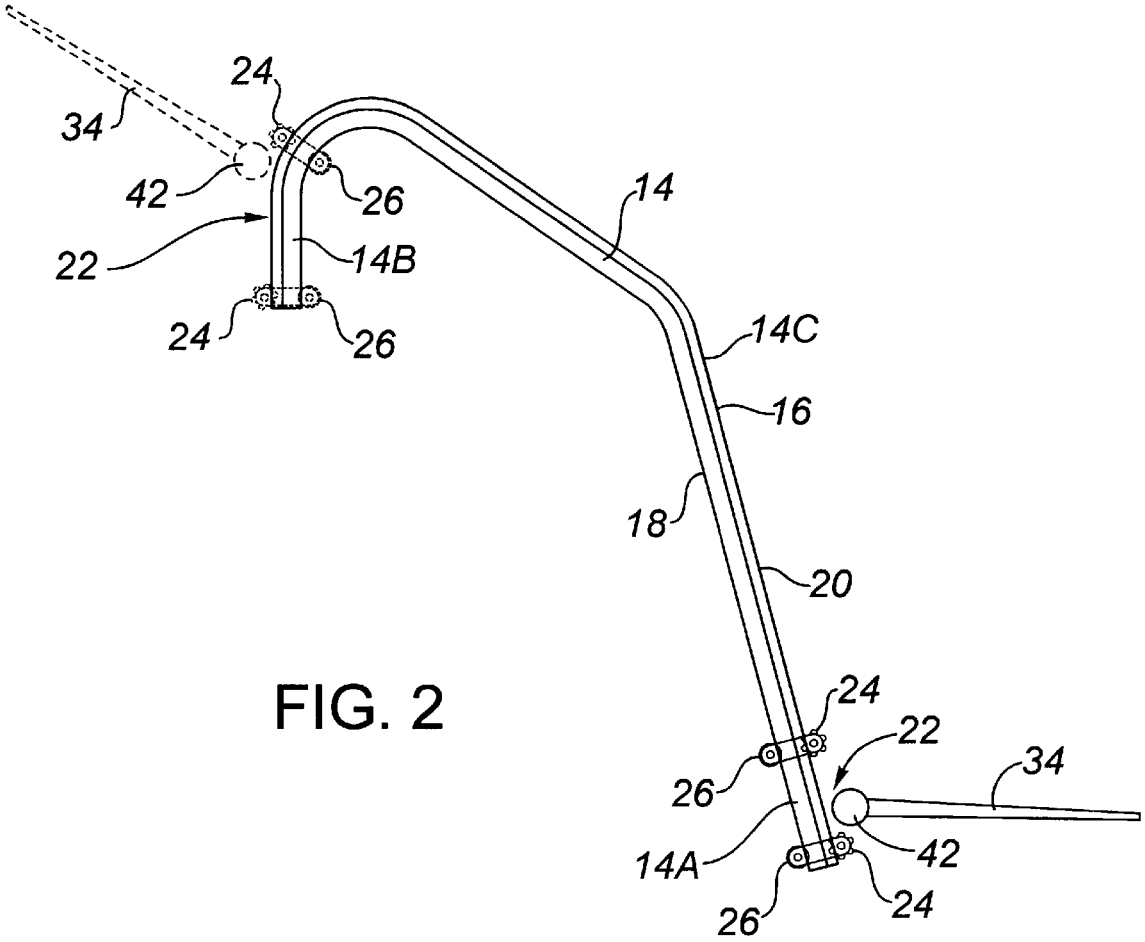
FIG. 2 is a detailed side elevation view of guide rails and trolley of the refuse loader illustrated in FIG. 1.

Referring to FIG. 2, each of the pair of guide rails 14 has a front face 16 and a back face 18. Also, each of the guide rails 14 has a sufficiently curved profile, in the form of a substantially inverted J shape, consisting of a vertical portion 14*a* corresponding to the loading position of the refuse container 38 onto trolley 22, an inverted vertical portion 14*b* corresponding to the dumping position the refuse container 38 on trolley 22, and an intermediate guiding portion 14*c* connecting between the vertical portion 14*a* and the inverted vertical portion 14*b*. The guide rails 14 are connected together in a parallel relationship to each other by a plurality of connecting plates 50 spacing the guide rails 14 a desired distance apart and supporting the guide rails on the garbage truck 12.

Figure 4:
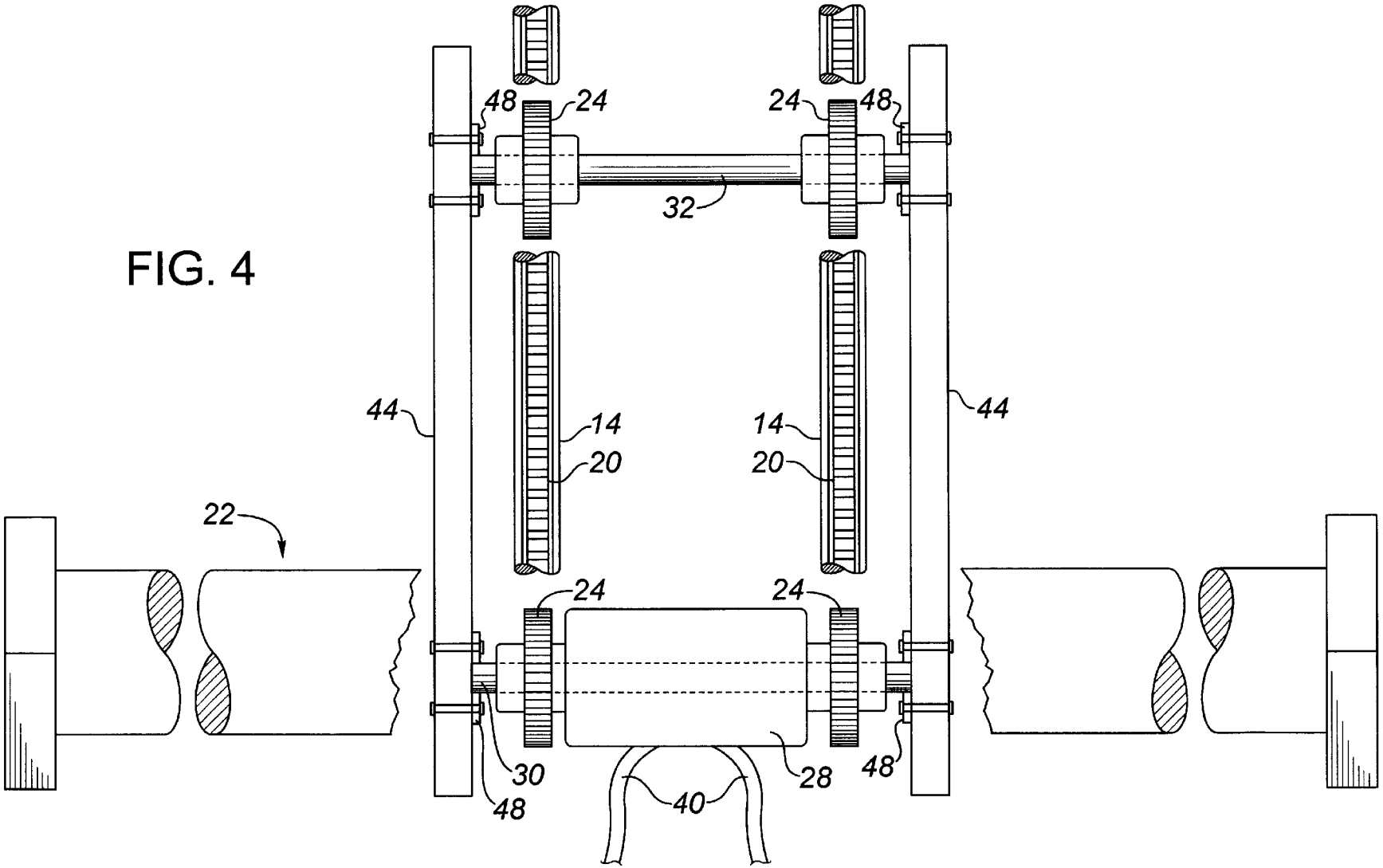
FIG. 4 is an enlarged front elevation cutaway view of the garbage truck illustrated in FIG. 1.
Figure 5:
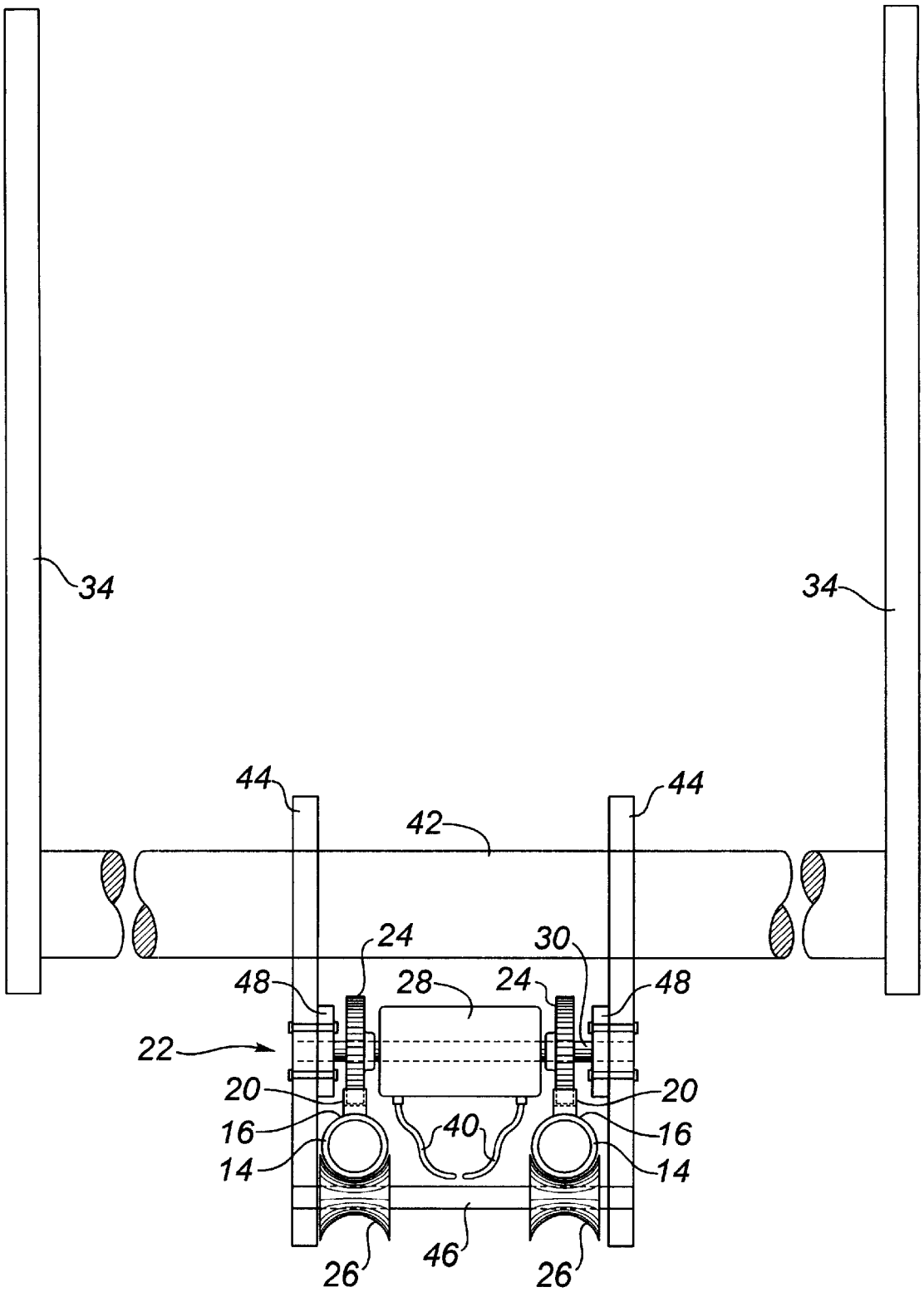
FIG. 5 is a bottom plan view of the guide rails and trolley illustrated in FIG. 2.

Referring to FIGS. 3 and 4, the front face 16 of each rail 14 has a longitudinally extending gear profile (rack) 20. Referring to FIGS. 1, 2, 4 and 5, the trolley 22 is provided with two sets of a pair of gears 24 and two sets of a pair of guide rollers 14. The sets are rotatably mounted between a pair of support frames 44 with the gear sets 24 on drive shaft 30 and driven shaft 32, and the roller sets on roller shafts 46. A pair of lifting arms 34 are fixedly mounted to the pair of support frames 44. The drive shaft 30 is driven by a motor 28 which is supported by the support frames 44. Referring to FIG. 5, each gear 24 engages the rack 20 of a guide rail 14, while rollers 26 directly contact and roll on the back faces 18 thereof with the result that guide rails 14 are captively engaged between guide rollers 26 and gears 24 so as to be able to move along the guide rails 14 from the normal vertical portions 14*a* to the inverted vertical portions 14*b* through the intermediate guide portions 14*c* under the control of the motor 28.

Referring to FIGS. 4 and 5, the drive shaft 30 and driven shaft 32 are rotatably mounted in bearing plates 48. Referring to FIGS. 1, 2, and 5, the trolley 22 has the pair of outwardly extending lifting arms 34 which are fixedly mounted by support 42 to the support frames 44. Referring to FIG. 1, lifting arms 34 extend into sleeves 36 of a refuse container 38 to detachably support refuse container 38 on trolley 22. The arms 34 fixedly mounted to the trolley 22 cause the refuse container 38 to be conveyed with trolley 22 along guide rails 14 with a fixed orientation relative to the trolley 22. Referring to FIGS. 1, 4, and 5 motor control cables 40 are provided for remotely activating motor 28. Motor control cables 40 are secured to a control console (not shown).

At least one of the gears/guide roller combinations are pivotable relative to the support frames 44 to facilitate negotiation of the trolley 22 along the curved portions of the guide rails 14.

The curvature of the guide rails 14 from the loading portion 14*a* to the inverted portion 14*b* subtends an angle of at least 90° and preferably at least 135°. However, this angle must be less than an angle which would allow the refuse container 38 to slide off arms 34 into the garbage truck when the trolley 22 is in the dump position.

The use and operation of refuse loader 10 will now be described with reference to FIGS. 1 through 5. The lifting arms 34 of trolley 22 are placed into sleeves 36 on the refuse container 38. Motor 28 on trolley 22 is then activated to rotate shaft 30 on which gears 24 are mounted. The rotation of gears 24 causes gears 24 to climb racks 20 on front faces 16 of guide rails 14, thereby raising trolley 22 along the normal vertical portions 14*a*, intermediate guide portions 14*c* and inverted vertical portions 14*b* of guide rails 14. During this movement trolley 22 is at all times maintained in engagement with guide rails 14, in view of the clamping action upon guide rails 14 of guide rollers 26 and gears 24. The profile of the guide rails 14 allows trolley 22 to move refuse container 38 from the loading position into the dumping position with one continuous motion.

The servicing of refuse loader 10 is greatly simplified with the configuration described. Guide rails 14 require little maintenance. Routine preventative maintenance is required on motor 28. A replacement trolley 22 can be substituted during periods these periods of routine maintenance to eliminate down time. The only time garbage truck may have to be temporarily taken out of service is when guide rails 14 or gear profile 20 are showing signs of wear. Even then replacement guide rails 14 can be substituted.

The refuse loader configuration, as described above, provides an additional benefit. Prior art refuse loaders having hydraulic cylinders, cylinder mounts and support arms added a considerable weight to a garbage truck. Due to weight restrictions on roadways, the weight of the refuse loader reduced the amount of garbage the garbage truck was capable of hauling. In addition to being more economical to build and maintain, the refuse loader, as described above, is much lighter. This allows more garbage to be hauled.

It will be apparent to one skilled in the art the advantages that are provided by refuse loader 10. If refuse loader 10 needs services, another refuse loader may readily be substituted while servicing takes place. This greatly simplifies services and reduces down time. It will also be apparent to one skilled in the art that modifications may be made to the illustrated embodiment without departing from the spirit and scope of the invention as hereinafter defined in the claims.

We claim:

1. A refuse loader with vehicle mounted guide rails, comprising:

a pair of guide rails at least one of which has a longitudinally extending gear rack;

a trolley having a motor, at least one driven gear driven by the motor, the driven gear engaging the longitudinally extending gear rack;

means for keeping the trolley engaged with the guide rails;

at least lifting one arm being fixedly secured to the trolley for detachably securing a refuse container to the trolley;

motor control means for activating the motor such that the driven gear rotates and conveys the trolley and said at least one said lifting arm along the guide rails as the driven gear moves along the longitudinally extending gear rack; and the guide rails having a sufficiently curved profile that enables said motor control means to be sole mechanism for conveying the trolley and said at least one lifting arm to a sufficiently inverted dumping position by following along the guide rails, thereby dumping the refuse container in one continuous motion without any pivoting motion of said at least one lifting arm.

2. The refuse loader as defined in claim 1, wherein rollers are the means for keeping the trolley engaged with the guide rails.

3. A refuse loader with vehicle mounted guide rails, comprising:

a pair of guide rails at least one of which has a longitudinally extending gear rack;

a trolley having a motor, at least one driven gear driven by the motor, the driven gear engaging the longitudinally extending gear rack, and at least one guide roller for clamping the guide rails between the driven gear and the guide roller so as to keep the trolley engaged with the guide rails;

at least one lifting arm being fixedly secured to the trolley for detachably securing a refuse container to the trolley;

motor control means for activating the motor such that the driven gear rotates and conveys the trolley and said at least one said lifting arm along the guide rails as the driven gear moves along the longitudinally extending gear rack; and the guide rails having a sufficiently curved profile that enables said motor control means to be sole mechanism for conveying the trolley and said at least one lifting arm to a sufficiently inverted dumping position by following along the guide rails, thereby dumping the refuse container in one continuous motion without any pivoting motion of said at least one lifting arm.

4. The refuse loader as defined in claim 3, wherein the trolley is detachably mounted onto the guide rails by the clamping action of the gears and guide rollers.

5. A refuse loader according to claim 3 comprising means for detachably mounting the pair of guide rails to the vehicle.

6. A refuse loader with vehicle mounted guide rails, the refuse loader comprising:

a pair of guide rails at least one of which has a longitudinally extending gear rack;

a trolley having a motor, at least one driven gear being driven by the motor, the driven gear engaging with and being movable along the longitudinally extending gear rack, and at least one guide roller for clamping the guide rails between the driven gear and the guide roller to maintain the trolley engaged with the guide rails;

at least one lifting arm being fixedly secured to the trolley for detachably securing a refuse container to the trolley to facilitate emptying of the refuse container when supported by the at least one arm;

motor controllor for activating the motor such that the driven gear rotates and conveys the trolley and said at least one said lifting arm, in a desired direction along the guide rails, as the driven gear moves along the longitudinally extending gear rack; and the guide rails having a sufficiently curved profile that enables said motor controller to be sole mechanism for conveying the trolley and said at least one lifting arm to a sufficiently inverted dumping position at an end position along the guide rails to facilitate dumping the supported refuse container in one continuous motion without requiring any pivoting motion of said at least one lifting arm.

* * * * *